US010294905B2

(12) United States Patent
Bernhardt

(10) Patent No.: US 10,294,905 B2
(45) Date of Patent: May 21, 2019

(54) HIGH-PRESSURE FUEL PUMP AND PRESSURE CONTROL DEVICE

(71) Applicant: Continental Automotive GmbH, Hannover (DE)

(72) Inventor: Joerg Bernhardt, Nuremberg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 157 days.

(21) Appl. No.: 15/031,513

(22) PCT Filed: Jun. 24, 2015

(86) PCT No.: PCT/EP2015/064309
§ 371 (c)(1),
(2) Date: Apr. 22, 2016

(87) PCT Pub. No.: WO2016/023665
PCT Pub. Date: Feb. 18, 2016

(65) Prior Publication Data

US 2017/0159628 A1 Jun. 8, 2017

(30) Foreign Application Priority Data

Aug. 14, 2014 (DE) ..... 10 2014 216 173

(51) Int. Cl.
*F01L 3/00* (2006.01)
*F02M 59/10* (2006.01)
(Continued)

(52) U.S. Cl.
CPC ..... *F02M 59/102* (2013.01); *F01L 3/20* (2013.01); *F04B 1/0408* (2013.01);
(Continued)

(58) Field of Classification Search
CPC .... F02M 59/102; F04B 1/0426; F04B 1/0439
(Continued)

(56) References Cited

U.S. PATENT DOCUMENTS 3,831,457 A * 8/1974 Kern ..... F01L 1/14 123/90.5
4,120,268 A * 10/1978 Bastenhof ..... F02M 25/03 123/25 C (Continued)

FOREIGN PATENT DOCUMENTS

DE 8129048 U1 3/1982 ..... F01L 1/24
DE 102007022220 A1 11/2008 ..... F02M 59/10

(Continued)

OTHER PUBLICATIONS

German Office Action, Application No. 102014216173.8, 5 pages, dated Jun. 8, 2015.

(Continued)

*Primary Examiner* — Marguerite J McMahon
*Assistant Examiner* — James J Kim
(74) *Attorney, Agent, or Firm* — Slayden Grubert Beard PLLC

(57) ABSTRACT

The present disclosure relates to a device for pressure control, including a rod and a plunger. The rod has a first end region delimiting a pressurized space and is movable along an axis between a top dead center and a bottom dead center. The plunger has a traverse substantially perpendicular to a plunger axis transmitting kinetic energy from a plunger drive to the rod in a contact region between a traverse surface and a second end region of the rod arranged opposite the first end region. The rod includes a calotte-shaped end region in the contact region of the rod and the traverse includes a calotte-shaped recess in the contact region of the traverse.

9 Claims, 12 Drawing Sheets

(51) Int. Cl.

| | |
|---|---|
| ***F04B 1/04*** | (2006.01) |
| ***F01L 3/20*** | (2006.01) |
| ***F04B 9/04*** | (2006.01) |
| ***F04B 19/22*** | (2006.01) |
| ***F04B 53/14*** | (2006.01) |

(52) U.S. Cl.
CPC ..... *F04B 1/0426* (2013.01); *F04B 1/0435* (2013.01); *F04B 9/042* (2013.01); *F04B 19/22* (2013.01); *F04B 53/144* (2013.01); *F02M 2200/02* (2013.01); *F02M 2200/03* (2013.01)

(58) Field of Classification Search
USPC ..... 123/188.3, 495; 417/273
See application file for complete search history.

(56) References Cited

U.S. PATENT DOCUMENTS

| | | | | |
|---|---|---|---|---|
| 4,204,814 | A * | 5/1980 | Matzen | F02M 59/102 417/437 |
| 5,131,818 | A * | 7/1992 | Wittkop | F04B 53/008 417/273 |
| 5,752,430 | A | 5/1998 | Kawajiri et al. | 92/129 |
| 6,347,574 | B1 * | 2/2002 | Guentert | F04B 1/0426 91/491 |
| 7,513,190 | B2 * | 4/2009 | Boehland | F02M 59/102 417/273 |
| 7,793,583 | B2 | 9/2010 | Radinger et al. | 92/129 |
| 2016/0153319 | A1 * | 6/2016 | Vier | F02M 63/0036 137/539.5 |

FOREIGN PATENT DOCUMENTS

| | | | | |
|---|---|---|---|---|
| DE | 102007057911 | A1 | 6/2009 | F01L 1/14 |
| DE | 102008008438 | A1 | 8/2009 | F04B 1/04 |
| JP | 0372051 | B2 | 11/1991 | B01J 31/00 |
| JP | 11343943 | A | 12/1999 | F02M 59/10 |
| JP | 2000179308 | A | 6/2000 | F01L 1/14 |
| JP | 2002501145 | A | 1/2002 | F02M 47/02 |
| JP | 2008144632 | A | 6/2008 | F02M 59/10 |
| WO | 2008/068116 | A1 | 6/2008 | F04B 1/04 |
| WO | 2016/023665 | A1 | 2/2016 | F02M 59/10 |

OTHER PUBLICATIONS

International Search Report and Written Opinion, Application No. PCT/EP2015/064309, 15 pages, dated Oct. 13, 2015.

Japanese Office Action, Application No. 2016555927, 2 pages, dated Sep. 19, 2017.

* cited by examiner

HIGH-PRESSURE FUEL PUMP AND PRESSURE CONTROL DEVICE

CROSS-REFERENCE TO RELATED APPLICATIONS

This application is a U.S. National Stage Application of International Application No. PCT/EP2015/064309 filed Jun. 24, 2015, which designates the United States of America, and claims priority to DE Application No. 10 2014 216 173.8 filed Aug. 14, 2014, the contents of which are hereby incorporated by reference in their entirety.

TECHNICAL FIELD

The present disclosure relates generally to pumps and, more specifically, to a high-pressure fuel pump and/or an engine valve for pressurizing a fuel.

BACKGROUND

Both in the case of engine valves and in the case, for example, of piston pumps that are used as high-pressure fuel pumps for the pumping of fuel, a rod is commonly provided which is driven by a plunger. The plunger itself is driven, for example in the case of a piston pump as a high-pressure fuel pump, by a camshaft of an internal combustion engine.

FIG. 12 shows a diagrammatic illustration of a rod 12 that is driven by a plunger 10. The arrangement illustrated in FIG. 12 may be used both in, for example, a piston pump 14 as a high-pressure fuel pump 16 and in engine valves 18. In both cases, high-pressure fuel pump 16 and engine valve 18, a movement of the rod 12, which in the case of the piston pump 14 constitutes a piston 20, influences a pressure in a space (not illustrated) which is arranged above the piston 20 in FIG. 12 and which is situated at a first end region 22 of the rod 12.

In the case of the piston pump 14, fuel is pressurized by way of the movement of the piston 20 along a piston axis 24.

In the case of an engine valve 18, the movement of the rod 12 along a rod axis 26 causes the engine valve 18 to be opened and closed, and thus, upon opening, a pressure is discharged, and upon closing of the engine valve 18, pressure is built up. Altogether, therefore, the arrangement shown in FIG. 12 constitutes a pressure-influencing device 28 both in the case of use in a piston pump 14 and in the case of use in an engine valve 18.

The pressure-influencing device 28 in FIG. 12 has a rod guide 30 for guiding the rod 12 and has a plunger guide 32 for guiding the plunger 10. The plunger 10 is constructed from a plunger skirt 34 and a traverse 36, and the traverse 36 is in contact, by way of the plunger skirt 34, with a roller 38. A camshaft moves the roller 38 upward and downward along a plunger guide axis 50, which in FIG. 12 coincides with the rod guide axis 52, wherein the roller 38 transmits said upward and downward movement to the traverse 36. The traverse 36 is in turn in contact with the rod 12 at a second end region 42 of the rod 12, and transmits the upward and downward movement to the rod 12, such that the latter can, by way of its first end region 22, influence a pressure in a space (not shown) arranged above the first end region 22 of the rod 12.

Also schematically illustrated in FIG. 12 is a flange 44, by way of which the pressure-influencing device 28 can be fastened for example to an engine housing.

SUMMARY

In general, in the case of a rod 12 driven by the plunger 10—for example in engine valves 18 or in piston pumps

14—considerable contact forces are generated at a contact point 46 between a rod end 48 in the second end region 42 of the rod 12 and the traverse 36 of the plunger 10. This is caused firstly by the axial load $F_a$ but also by way of geometrical tolerances of the individual components of the pressure-influencing device 28 and the respective play of the individual elements in the pressure-influencing device 28.

In detail, the following forces act:

- The Hertzian stress or the Hertzian contact ($F_a$, see FIG. 12) owing to the axial force $F_a$, which effects a flattening of the surfaces that are in contact with one another, such that a contact surface of enlarged contact area exists rather than ideal punctiform contact;
- Transverse forces (see FIG. 13) which result from an angle error $\alpha$ between a plunger guide axis 50 and the rod axis 26;
- Transverse forces resulting from the contact angle $\beta_1$ between the rod axis 26 and the normal at the contact point between the traverse 36 and the rod 12 (see FIG. 13);
- Transverse forces resulting from the contact angle $\beta_2$ between the plunger axis 40 and the normal at the contact point between the traverse 36 and the plunger 10 (see FIG. 13);
- Contact moments as a product of the axial load $F_a$ and the spacings $a_1$ and $a_2$ of a contact point K between traverse 36 and rod 12 to the plunger guide axis 50 and to a rod guide axis 52 respectively (cf. FIG. 13). The contact moments arise owing to the contact angles $\beta_1$ and $\beta_2$, the concentricity error of the two guide axes 50, 52, that is to say the angle error $\alpha$, and the spacing between the plunger guide axis 50 and an intersection point S of a flange surface 54 of the flange 44 with the rod guide axis 52.

All of these forces lead to considerable bearing reaction forces both in the plunger guide 32 and in the rod guide 30, which bearing reaction forces can lead to wear and ultimately to abrasion of the linear or sliding guides. The maximum admissible bearing reaction forces in the guides 50, 52 determine the maximum admissible errors of the overall system.

Until now, to improve the system, close tolerances, and associated high production costs, and/or an increase of the guide lengths, have/has been implemented. Here, the individual forces are influenced as follows:

- To be able to compensate the Hertzian stress and the angle error $\alpha$ between the guide axes 50, 52, a spherical rod end 48, in particular of calotte-shaped form, is used. Here, the expression "calotte" encompasses all segments on dome-shaped bodies. The calotte-shaped rod end 48 is, as shown in FIG. 13, placed against a planar traverse 36. The planarity of the traverse 36 permits both a convex and a concave surface, which leads to considerable scatter of the Hertzian stress. To achieve admissible Hertzian stresses, either the tolerances for the planarity and/or the tolerances for the shape of the calotte-shaped rod end 48 must be reduced, which is associated with an increase in production costs. Furthermore, it is also possible for the radius of the calotte-shaped rod end 48 to be increased, though this increases the contact moment. For compensation, it is therefore necessary in turn to limit the tolerances, which likewise leads to an increase in production costs.
- Transverse forces resulting from the angle error $\alpha$ can be reduced only by restricting the tolerances, which is associated with higher manufacturing costs. The resulting transverse forces may also be reduced by way of a lower stiffness or transverse spring rate of the rod 12, which can normally be achieved only with difficulty owing to the axial load $F_a$ and the required component strength.

The angle error is, overall, the sum of the angle error $\alpha$ between the guide axes 50, 52, the guide clearances (that is to say tilting of the plunger 10 in the plunger guide 32 or of the rod 12 in the rod guide 30), and the perpendicularity $\gamma$ of the traverse 36, that is to say the angle error of the traverse 36 with respect to the guide diameter of the plunger 10, that is to say of the plunger skirt 34. The sum of said angle errors are the contact angles $\beta_1$ and $\beta_2$. The resultant transverse force on the rod 12 is calculated using the term $\sin \beta_1 \times F_a$. The resultant transverse force on the plunger 10 is calculated using the term $\sin \beta_2 \times (F_a \times 1/\cos \alpha)$. Said transverse forces can be reduced only by reducing the tolerances and/or, to a limited extent, by increasing the guide lengths. Both however lead to an increase in production costs.

The lever arms $a_1$ and $a_2$ to the guide axes 50, 52 result from the concentricity errors of the guides 50, 52 with respect to one another and the contact angles $\beta_1$ and $\beta_2$, which result from the angle errors $\alpha$, $\gamma$ and the radius of the calotte-shaped rod end 48. This leads to the radial migration of the contact point K, and generates the lever arms $a_1$ and $a_2$. To reduce the lever arms $a_1$ and $a_2$, it is possible, on the one hand, to restrict the tolerances of the concentricity errors or of the radius of the calotte-shaped rod end 48. This however does not lead to a significant improvement, but does lead to increasing production costs. Alternatively, the nominal value of the radius of the calotte-shaped rod end 48 may be reduced, which is however normally possible only with difficulty owing to the Hertzian stresses.

Altogether, therefore, the considerable contact forces that prevail in a construction according to the prior art as per FIG. 12 and FIG. 13 in the case of the contact of a calotte-shaped rod end 48 with a planar traverse 36 can be lessened only with a considerable increase in production costs, and only to an unsatisfactory extent.

In accordance with the teachings of the present disclosure, a high-pressure fuel pump for pressurizing a fuel has a piston which is arranged so as to be movable along a piston axis between a first, top dead center and a second, bottom dead center, and a plunger with a traverse which is arranged substantially perpendicular to a plunger axis and which serves for transmitting kinetic energy from a plunger drive to the piston in a contact region between a traverse surface and an end region of the piston. In the contact region, the piston has a calotte-shaped end region, and the traverse has a likewise calotte-shaped recess.

The "top dead center" is to be understood to mean a position of the rod in which the rod is, by a drive, for example a camshaft, pushed to its highest deflection point along the rod axis relative to an axis of, for example, the camshaft. Analogously, the expression "bottom dead center" is to be understood to mean the point at which the rod is situated closest to the axis of, for example, the camshaft.

Correspondingly, a pressure-influencing device for influencing a pressure in a medium has a rod with a first end region for delimiting a space which has the medium, wherein the rod is arranged so as to be movable along a rod axis between a first, top dead center and a second, bottom dead center. Also provided is a plunger with a traverse which is arranged substantially perpendicular to a plunger axis and which serves for transmitting kinetic energy from a plunger drive to the rod in a contact region between a traverse surface and a second end region of the rod, said second end region being arranged opposite the first end region. In the contact region, the rod has a calotte-shaped end region, and the traverse has a likewise calotte-shaped recess.

Thus, the second end region of the rod is formed by the calotte-shaped end region.

Here, the pressure-influencing device may be a high-pressure fuel pump or an engine valve. In the case of the high-pressure fuel pump, the rod is then formed by the piston.

By way of the described arrangement, it is now the case that the rod, by way of its calotte-shaped rod end, moves no longer on a planar traverse but in a calotte-shaped depression, that is to say the previous "calotte/surface contact" is replaced with "calotte/calotte contact". Here, a calotte, in particular a spherical calotte, is formed into the previously planar surface of the traverse. In this way, for the same Hertzian stress, it is possible to select a smaller radius on the calotte-shaped end region of the rod. The angle error $\gamma$ is thereby eliminated entirely. Only a slight concentricity error remains between a rod axis and a central point of the calotte shape. This has a positive effect on the transverse forces and the resulting moments, because the contact angles $\beta_1$ and $\beta_2$, and the lever arms $a_1$ and $a_2$, are reduced.

This is because, owing to the calotte-shaped recess in the traverse, a contact point K between the traverse and the rod is shifted from an outer edge region of the calotte-shaped end region of the rod toward the rod axis. In this way, the described lever arms $a_1$ and $a_2$, which define spacings between the contact point K and a plunger guide axis and rod guide axis respectively, and the contact angles $\beta_1$, $\beta_2$, which define angles in each case of a normal to the traverse at the contact point K with respect to a rod axis and a plunger axis respectively, are considerably reduced.

In this way, the contact forces acting between the elements can be considerably reduced, but without changing tolerances and guide lengths to an excessive extent, such that altogether, an improved transmission of kinetic energy from the plunger to the rod can be achieved, without the production costs being excessively increased in the process. The traverse preferably has, in regions adjoining the calotte-shaped recess, a traverse surface which is of planar form substantially perpendicular to the plunger axis. Thus, that region of the traverse surface which comes into contact with the calotte-shaped end region of the rod is preferably not entirely of calotte-shaped form but additionally still has planar sub-regions. This is advantageously conducive to reinforcing the traverse overall. Furthermore, it may however also be advantageous for further measures to be implemented for stiffening the traverse, for example if the traverse is of thicker form parallel to the plunger axis, or is formed from a stiffer material, in relation to a traverse from the prior art.

It is possible for the calotte-shaped recess to be generated in the traverse surface by being formed into a planar traverse surface by stamping. An inexpensive realization of the traverse surface geometry is possible in this way.

In some embodiments, the calotte-shaped recess is arranged symmetrically about an axis which bisects the traverse perpendicularly to the longitudinal axis thereof. This means that the calotte-shaped recess is arranged, overall, symmetrically on that side of the traverse which comes into contact with the calotte-shaped end region of the rod. In this way, it is possible for a defined position of a central point of the calotte-shaped recess on the traverse to be generated, which in turn leads to defined guidance of the rod by the traverse.

The traverse may be arranged so as to be movable radially with respect to the plunger axis, wherein the traverse is inserted into the plunger without radial fastening. In this way, it is possible for the concentricity errors to be compensated by way of the radially movable traverse. This is because the concentricity errors constitute only a very small fraction of the lever arms $a_1$ and $a_2$; they constitute a static position error of the calotte shape. In the case of an traverse that is movable radially with respect to the plunger axis, it is thus the case that the traverse finds its position within the initial strokes of the rod, and can thus compensate the static position error.

A recess radius of the calotte-shaped recess of the traverse is greater than a rod radius of the calotte-shaped end region of the rod. This yields the advantage that the rod is, in all operating states, reliably situated with its calotte-shaped end region in the calotte-shaped recess of the traverse.

Some embodiments include a rod guide having a rod guide axis, wherein a rod end radius of the calotte-shaped end region of the rod is smaller than or equal to a spacing, which exists at the top dead center of the rod, between a tangent to a rod calotte surface at the rod axis and an intersection point of the plunger axis and the rod guide axis.

The spacing between the tangent to the calotte-shaped end region of the rod, at the point at which the rod axis intersects an outer surface of the rod, and an intersection point of the plunger axis with the rod guide axis changes during the operation of the rod. The spacing is smaller at the top dead center of the rod than at the bottom dead center and in all operating states in between. This means that the radius of the calotte-shaped end region of the rod is selected to be smaller than or equal to the smallest spacing between the intersection point of the guide axes and a smallest protrusion of the rod end—in the position at top dead center. This has the effect that the contact angles $\beta_1$ and $\beta_2$ are smaller than or equal to the angle error $\alpha$, and it is thus the case that only low transverse forces act.

If, for construction-related reasons, it is not possible for the rod end radius of the calotte-shaped end region of the rod to be designed to be smaller than the described minimum spacing at top dead center, the recess radius of the calotte-shaped recess may b considerably greater than the radius of the calotte-shaped end region. Here, a rod guide having a rod guide axis is provided, wherein a rod end radius of the calotte-shaped end region of the rod is greater than a spacing, which exists at the top dead center of the rod, between a tangent to a rod calotte surface at the rod axis to an intersection point of the plunger axis and the rod guide axis, wherein a recess radius of the calotte-shaped recess of the traverse is greater than a rod end radius of the calotte-shaped end region of the rod, to such an extent, in the case of identical materials being used, that the Hertzian stress is situated in the region of contact between a planar traverse surface and a calotte-shaped end region of the rod.

This means that, if the radius of the calotte-shaped end region of the rod cannot be realized for example owing to Hertzian stress values having increased to too great an extent owing to the very small radius of the end region, the values of the Hertzian stress should be compensated by way of a larger radius of the calotte-shaped recess. This is because, the greater the radius of the calotte-shaped recess of the traverse is, the smaller the contact surface between the end region of the rod and traverse surface becomes, owing to the Hertzian stress. In relation to an arrangement in which no calotte-shaped recess is provided in the traverse, it should be the case that at least similar values for the Hertzian stress are realized.

The pressure-influencing device may be a high-pressure fuel pump, though may alternatively also be an engine valve. An example embodiment of the invention will be discussed in more detail below on the basis of the appended drawings.

DETAILED DESCRIPTION

Below, the expressions "rod" and "piston" are synonymous with one another. The same applies to the expressions "pressure-influencing device", "engine valve" and "high-pressure fuel pump".

Figure 1:
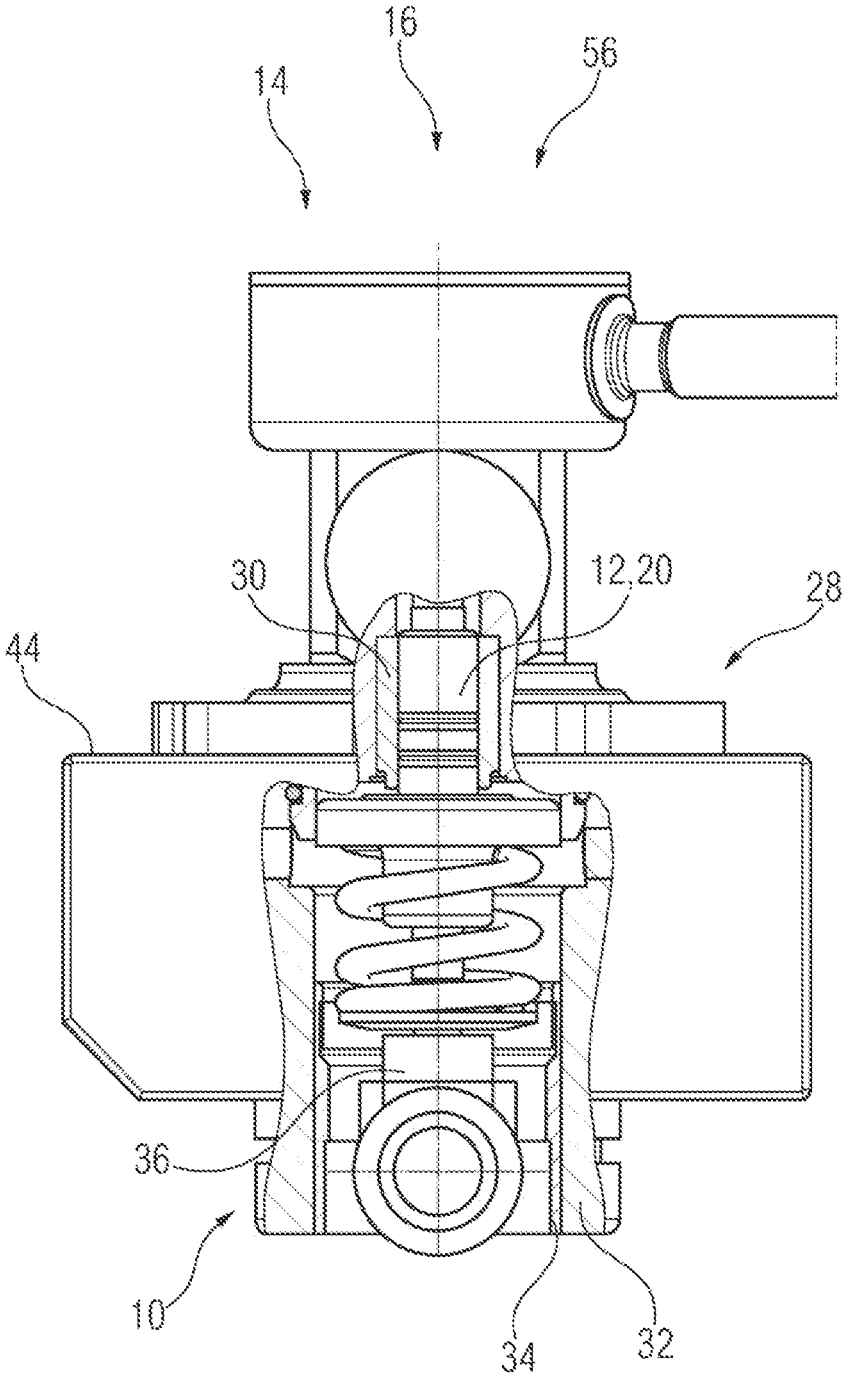
FIG. 1 shows a detail of an internal combustion engine having a pressure-influencing device, wherein the pressure-influencing device is a high-pressure fuel pump which is fastened by way of a flange in the internal combustion engine according to teachings of the present disclosure.

FIG. 1 shows an internal combustion engine 56 to which a pressure-influencing device 28 in the form of a high-pressure fuel pump 16 is fastened by way of a flange 44. The pressure-influencing device 28 has a plunger 10 with a plunger guide 32, with a plunger skirt 34 and with a traverse 36. Furthermore, the pressure-influencing device 28 has a rod 12 in the form of a piston 20 and a rod guide 30.

Figure 2:
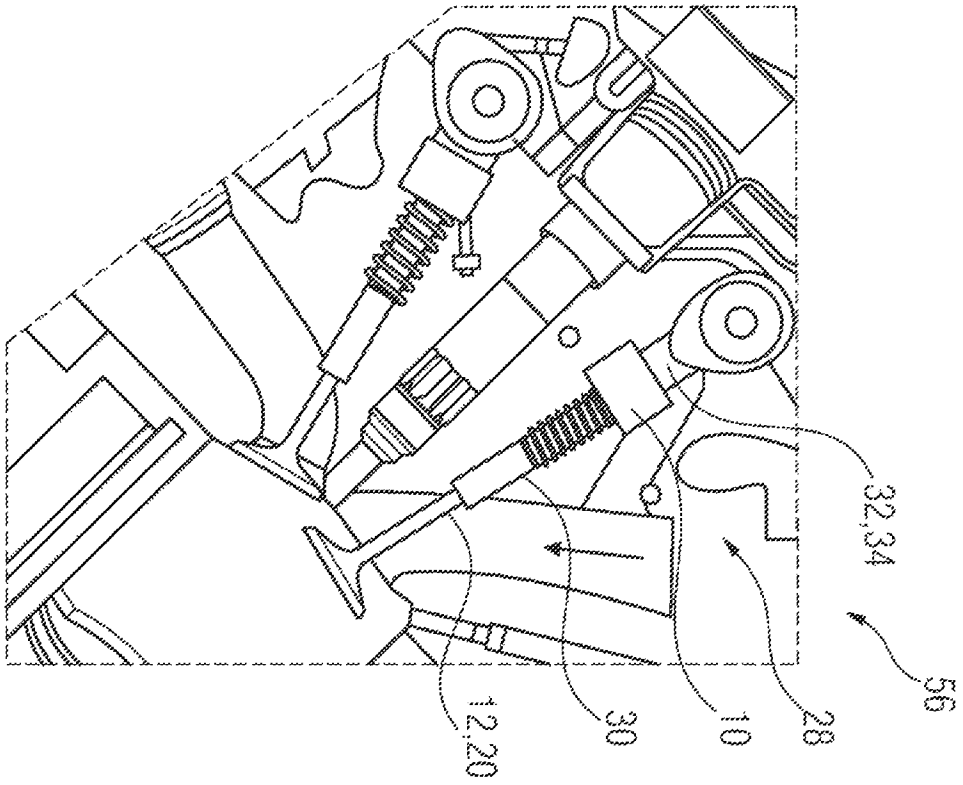
FIG. 2 shows a detail of an internal combustion engine having a pressure-influencing device without flange fastening according to teachings of the present disclosure.

FIG. 2 shows a pressure-influencing device 28 with plunger 10 and plunger guide 32 and plunger skirt 34 and with rod guide 30 and rod 12. In the case of the internal combustion engine 56 shown in FIG. 2, no flange 44 is provided.

Figure 3:
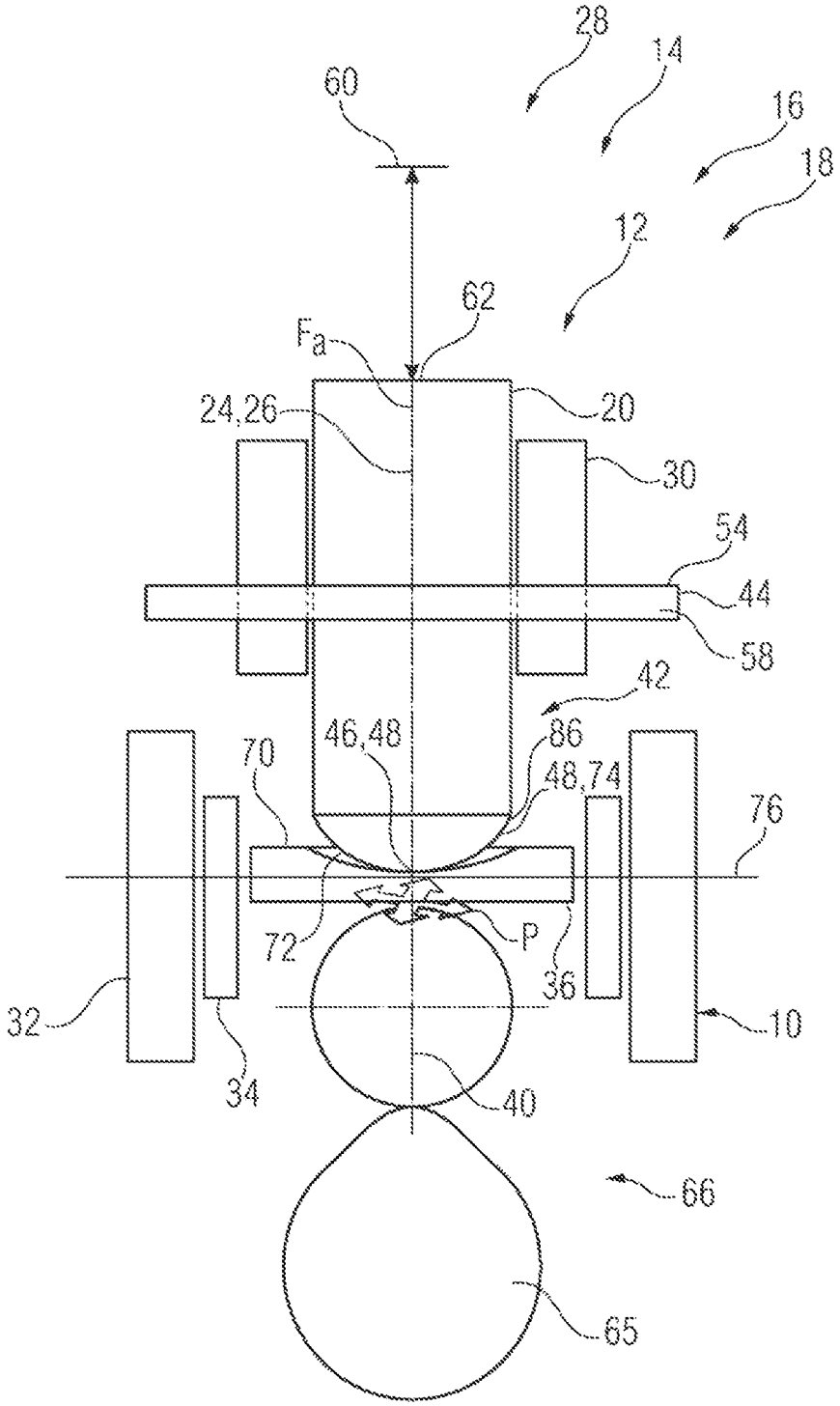
FIG. 3 shows the pressure-influencing device from FIG. 1 and FIG. 2, with a calotte-shaped recess in a traverse of a plunger.

FIG. 3 schematically illustrates the pressure-influencing device from FIG. 1 with flange 44, which forms a flange plane 58. The pressure-influencing device 28 in the form of the high-pressure fuel pump 16 has the plunger 10 with plunger guide 30, plunger skirt 34 and traverse 36, and the rod 12 with rod guide 30. The rod 12 of the traverse 36 is driven along a rod axis 26 between a first, top dead center 60 and a second, bottom dead center 62, that is to say is moved up and down. The traverse 36 is in turn driven by way of a roller 38, which is arranged underneath the traverse 36, along a plunger axis 40, which coincides with the rod axis 26 in the idealized illustration of the pressure-influencing device 28 shown in FIG. 3. The roller 38 is driven by way of a camshaft 65 of the internal combustion engine 56.

The roller 38 and the camshaft 65 thus jointly form a plunger drive 66.

In the idealized illustration in FIG. 3, not only the plunger axis 40 and the rod axis 26 but also a plunger guide axis 50, that is to say the axis of the plunger guide 32, and a rod guide axis 52, that is to say the axis of the rod guide 30, coincide.

As can also be seen in FIG. 3, the rod 12, or the piston 20, has a clearance in the rod guide 30, and the plunger 10 also has a clearance in the plunger guide 32. Furthermore, the traverse 36 is mounted movably in the plunger skirt 34, as indicated by the arrows P, and is movable radially relative to the plunger axis 40 in all directions.

In the ideal embodiment of the pressure-influencing device 28, the traverse 36 and the rod 12 make punctiform contact in a contact region 68 of a traverse surface 70 and of a second end region 42, which is situated opposite a first end region 22, of the rod 12. In the contact region 68, the traverse has a calotte-shaped recess 72, and the rod 12 has a calotte-shaped end region 74. The calotte-shaped recess 72 does not span the entire traverse surface 70, but rather the traverse 36 has, adjacent to the calotte-shaped recess 72, a traverse surface which is of planar form perpendicular to the plunger axis 40. The calotte-shaped recess 72 may be formed into the traverse surface 70 for example by stamping. The calotte-shaped recess 72 is arranged symmetrically on the traverse surface 70, such that the lowest point of the calotte-shaped recess 72 is intersected by the plunger axis 40, which runs perpendicular to a longitudinal axis 76 of the traverse 36.

Figure 4:
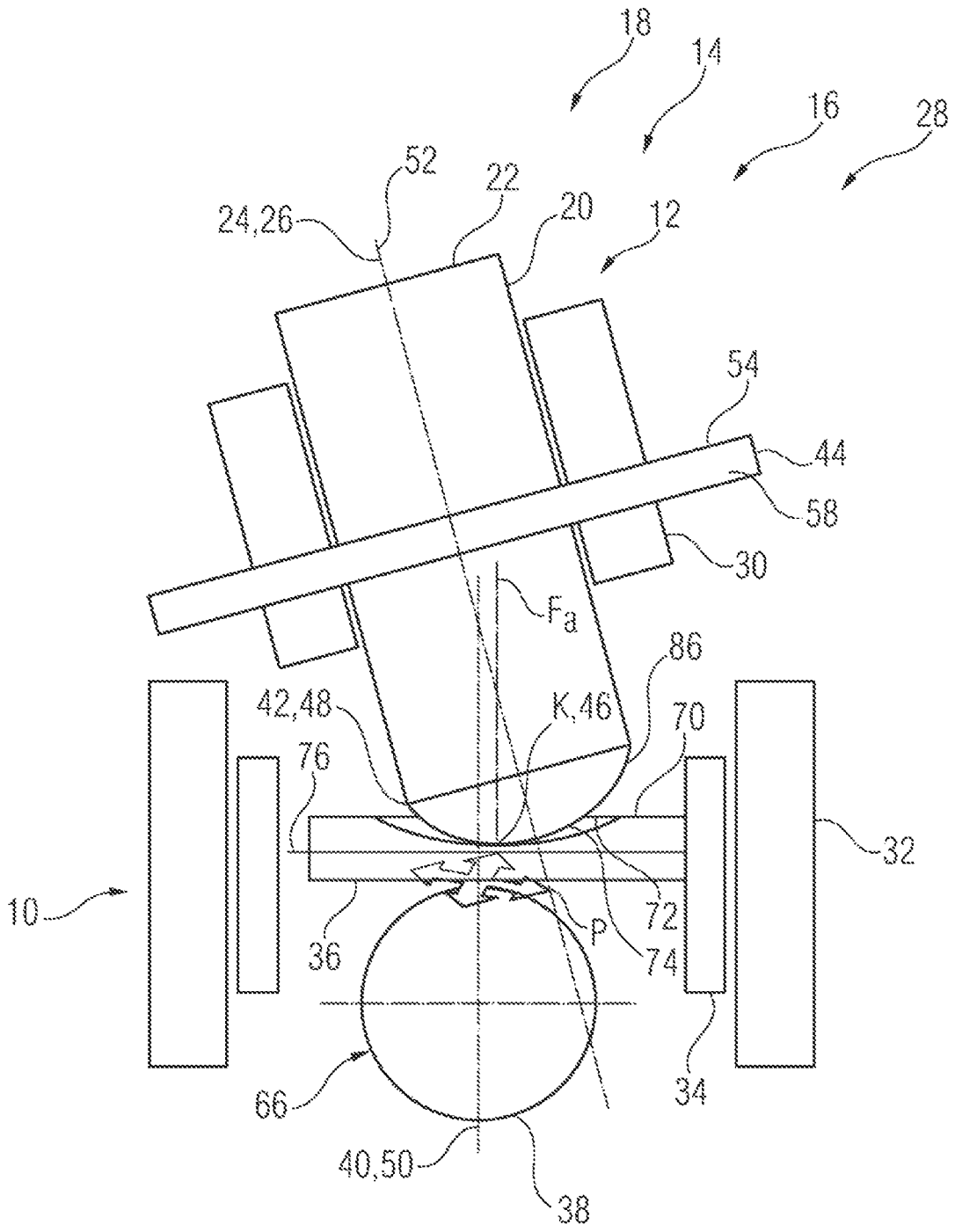
FIG. 4 shows the pressure-influencing device from FIG. 3, with angle error positions.

FIG. 3 shows merely an idealized illustration of the pressure-influencing device 28, whereas FIG. 4 illustrates, overlaid thereon, the conditions that actually prevail. In reality, the plunger guide axis 50 and the rod guide axis 52 and/or the plunger axis 40 and the rod axis 26 do not coincide, such that transverse forces act in addition to an axial force $F_a$ acting perpendicularly on the rod 12. Said transverse forces can be minimized by way of the combination of calotte-shaped recess 72 in the traverse surface 70 and the calotte-shaped end region 74 on the second end region 42 of the rod 12.

Figure 6:
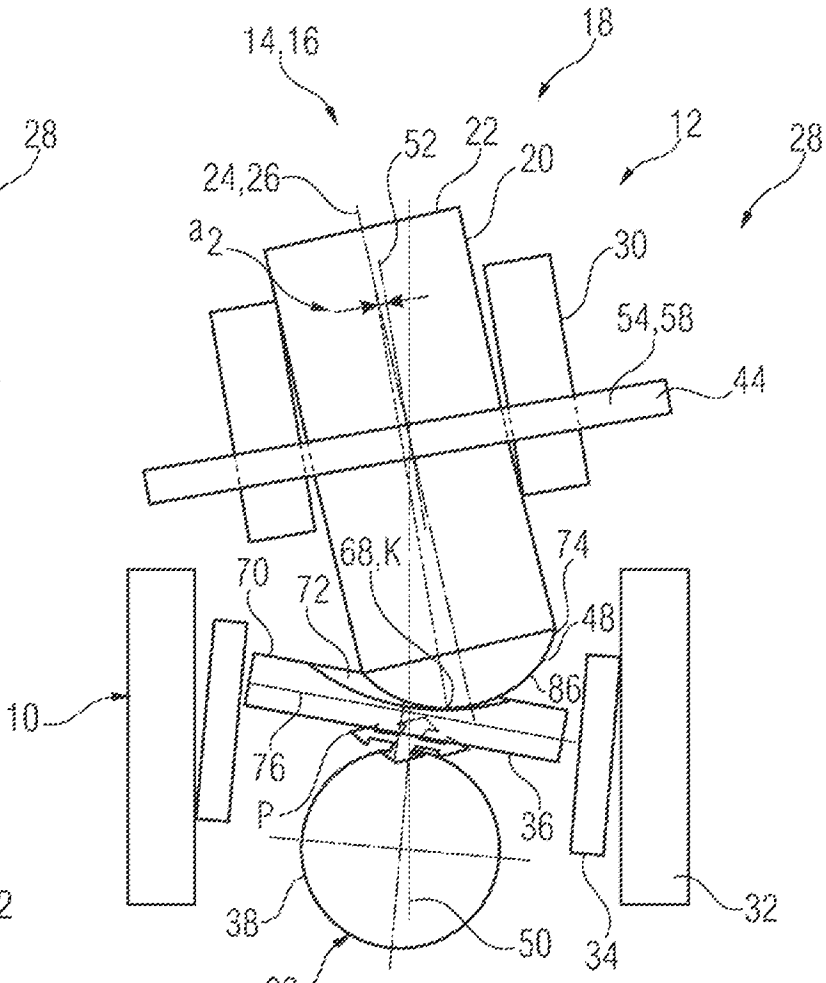
FIG. 6 shows the pressure-influencing device from FIG. 1 and FIG. 2, with a calotte-shaped recess in the traverse.
Figure 5:
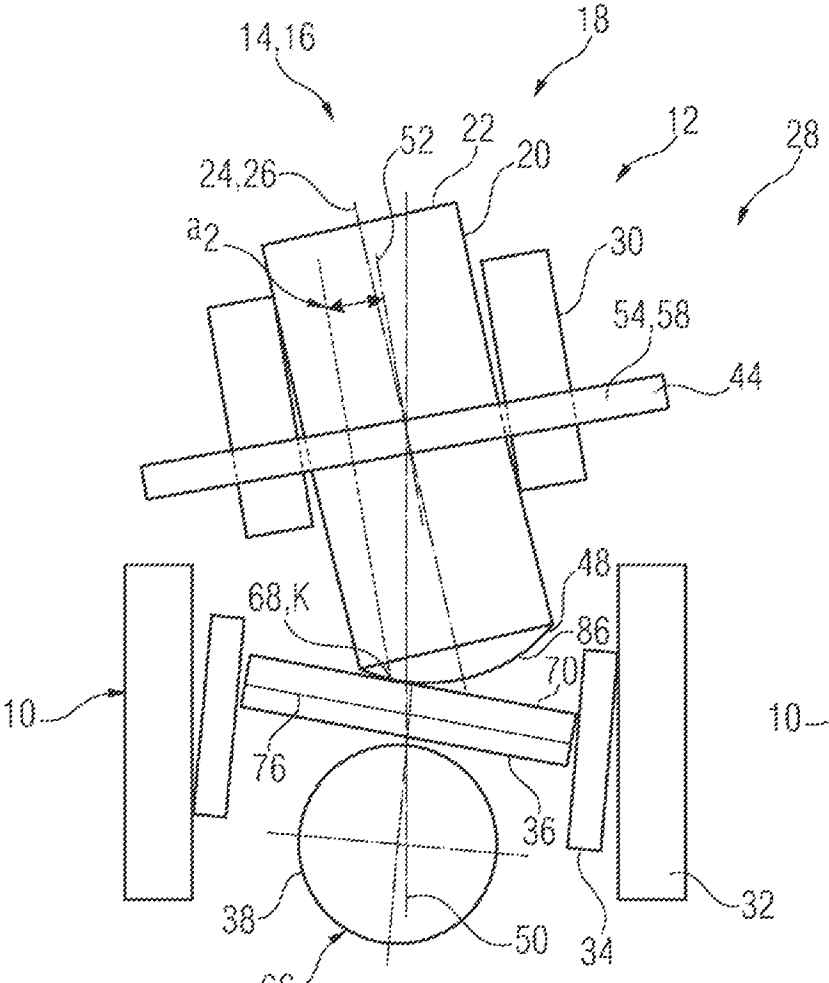
FIG. 5 shows the pressure-influencing device from FIG. 1 and FIG. 2, wherein the traverse does not have a calotte-shaped recess.

This is shown by a comparison between a pressure-influencing device according to the prior art, as shown in FIG. 5, and the example pressure-influencing device 28 as shown in FIG. 6. Comparing the two illustrations in FIG. 5 and FIG. 6, it can be seen that, for the same inclination of the rod axis 26 about the plunger guide axis 50, a contact point K between the calotte-shaped end region 74 and traverse 36 is considerably further remote from the rod axis 26 in the case of a pressure-influencing device 28 as per FIG. 5 than in the pressure-influencing device 28 as per FIG. 6. Said relatively large spacing also yields greater contact angles $\beta_1$, $\beta_2$ and increased acting transverse forces.

Figure 7:
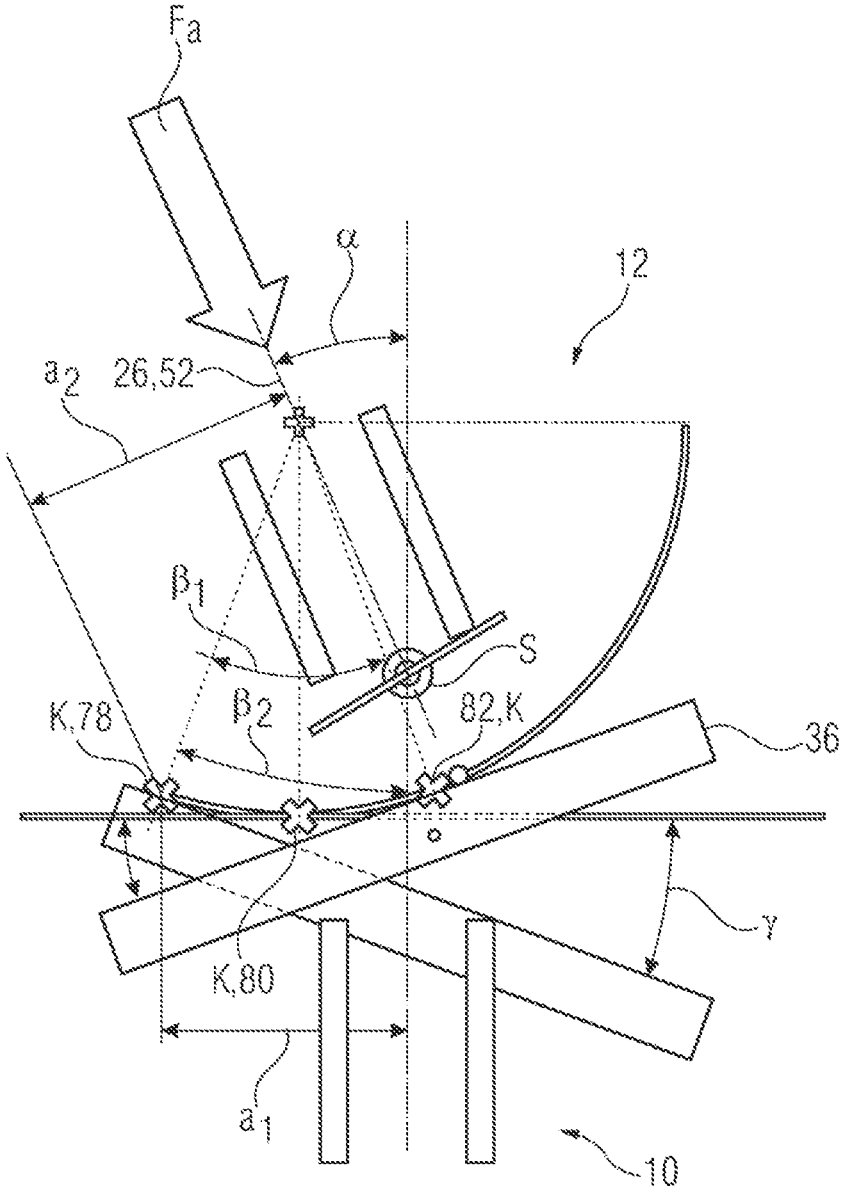
FIG. 7 is a schematic geometrical illustration of the pressure-influencing device from FIG. 5, for illustrating the contact angles and lever arms.

FIG. 7 illustrates the situation of the pressure-influencing device 28 from FIG. 5 schematically in a geometrical arrangement. For better understanding, the clearance in the guides 30, 32 and the concentricity error at an intersection point S between rod axis 26 and plunger axis 40 have not been illustrated, because said errors are generally very small in relation to the errors illustrated.

As can be seen in FIG. 7, the traverse 36 may have an angle error $\gamma$ both in a positive direction and in a negative direction. Furthermore, the tilting of the rod 12 away from the plunger axis 40 yields the angle error $\alpha$. The contact angles $\beta_1$, $\beta_2$ result from the sum of $\alpha$ and $\gamma$.

This means that the angle error $\gamma$ may, in expedient situations, hereinafter referred to as "best case", compensate the angle error $\alpha$, depending on sign. Said angle error $\gamma$ may however also further increase the angle error $\alpha$, this being referred to hereinafter as "worst case".

The sum of $\alpha$ and $\gamma$ results in the contact points, illustrated in FIG. 7, for the "worst case" (contact point 78), a "neutral case" (contact point 80) and for the "best case" (contact point 82). For the case of the contact point 78, the contact angles $\beta_1$, $\beta_2$ are shown, which are relatively large. Also shown are the acting axial force $F_a$ on the rod axis 26 and the lever arms $a_1$ and $a_2$, which constitute the spacing of the respective contact point 78, 80, 82 from the plunger axis 40 or from the rod axis 26. The greater the contact angles $\beta_1$, $\beta_2$, and thus the greater the lever arms $a_1$ and $a_2$, the greater the transverse forces acting on the pressure-influencing device 28.

Figure 8:
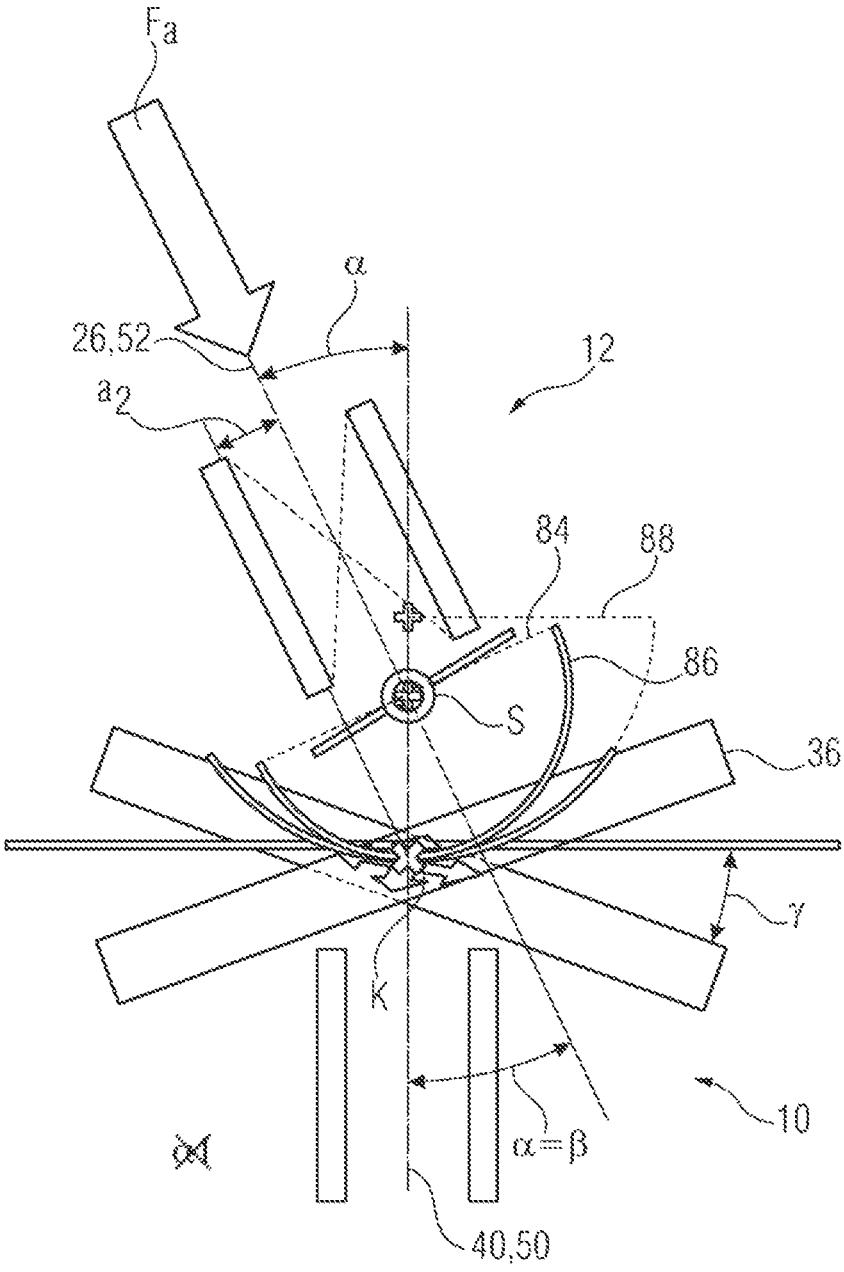
FIG. 8 is a schematic geometrical illustration of the pressure-influencing device from FIG. 6, for illustrating the contact angles and lever arms that exist.

FIG. 8 geometrically illustrates the situation of the pressure-influencing 28 as per FIG. 6. Here, owing to the calotte-shaped recess 72 in the traverse 36, the angle error $\gamma$ of the traverse 36 becomes irrelevant. This means that the contact angle $\beta$ can only be as great as the angle error $\alpha$. As a result, it is also the case that only the lever arm $a_2$ exists, that is to say a spacing between contact point K and rod axis 26, the lever arm $a_1$, is omitted.

Altogether, this yields considerably lower transverse forces acting on the pressure-influencing device 28, which leads to considerably lower loads and considerably less wear of the pressure-influencing device 28.

In some embodiments, the Hertzian stresses may be kept constant without restriction of the production tolerances. This can be realized through selection of the radius relationships of calotte-shaped recess 72 and calotte-shaped end region 74. Here, a distinction is made between two cases. The distinguishing criterion is the condition that the Hertzian stress should not be increased in relation to an arrangement of the pressure-influencing device 28 as shown in FIG. 5. This determines whether a rod end radius 84 of the calotte-shaped end region 74 of the rod 12 can be designed to be smaller than or equal to a minimum spacing $a_{min}$, at the top dead center 60 of the rod 12, between a tangent T to a rod calotte surface 86 at the point of the rod axis 26 and the intersection point S of the plunger axis 40 and the rod guide axis 52.

Figure 9:
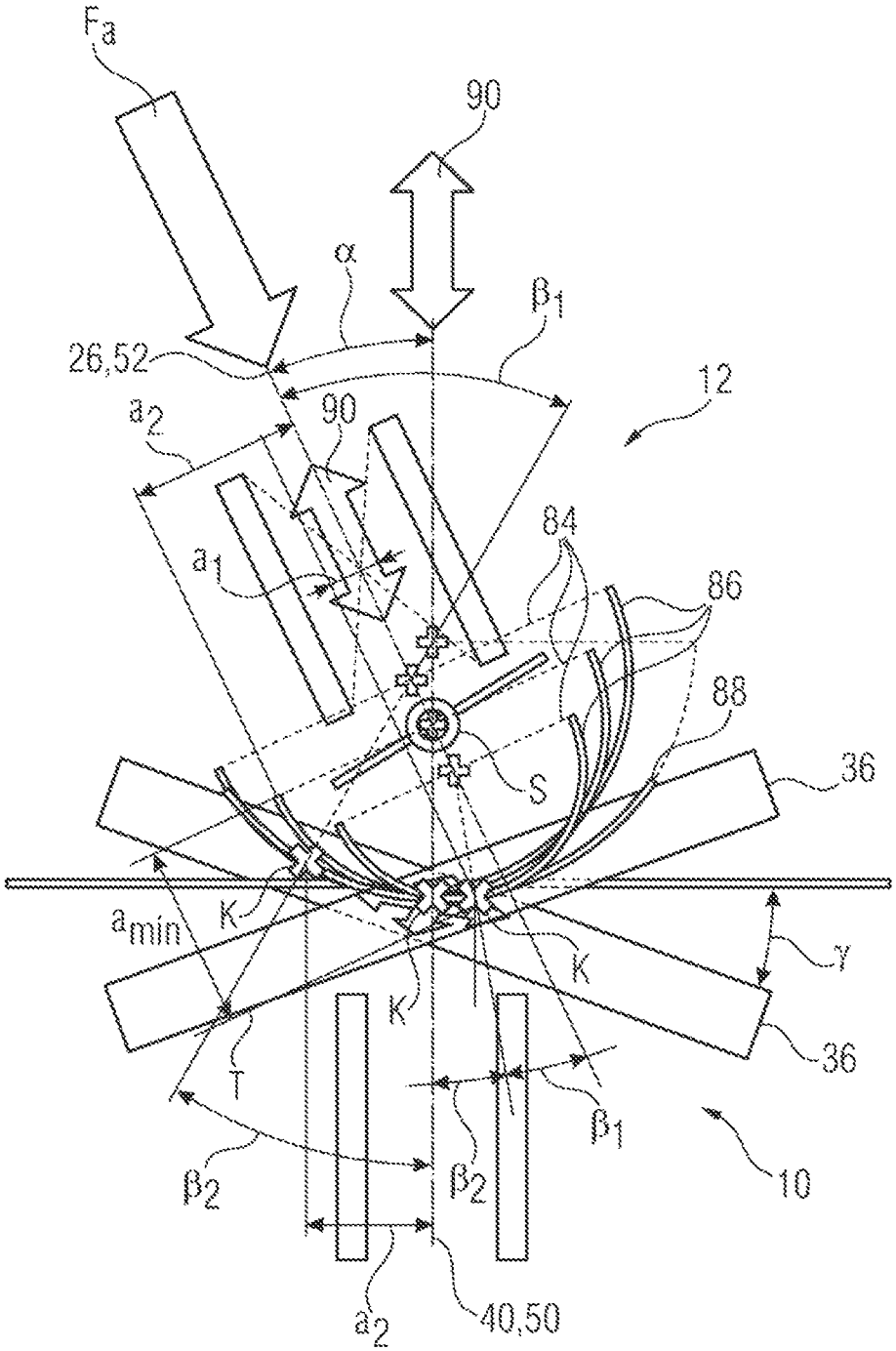
FIG. 9 is a schematic geometrical illustration of the pressure-influencing device from FIG. 6, for illustrating ideal radius relationships of the calotte-shaped recess and of a calotte-shaped end region of a rod.

In the first case, it is possible for the rod end radius 84 to be designed to be smaller than the spacing $a_{min}$, as illustrated in FIG. 9.

Figure 10:
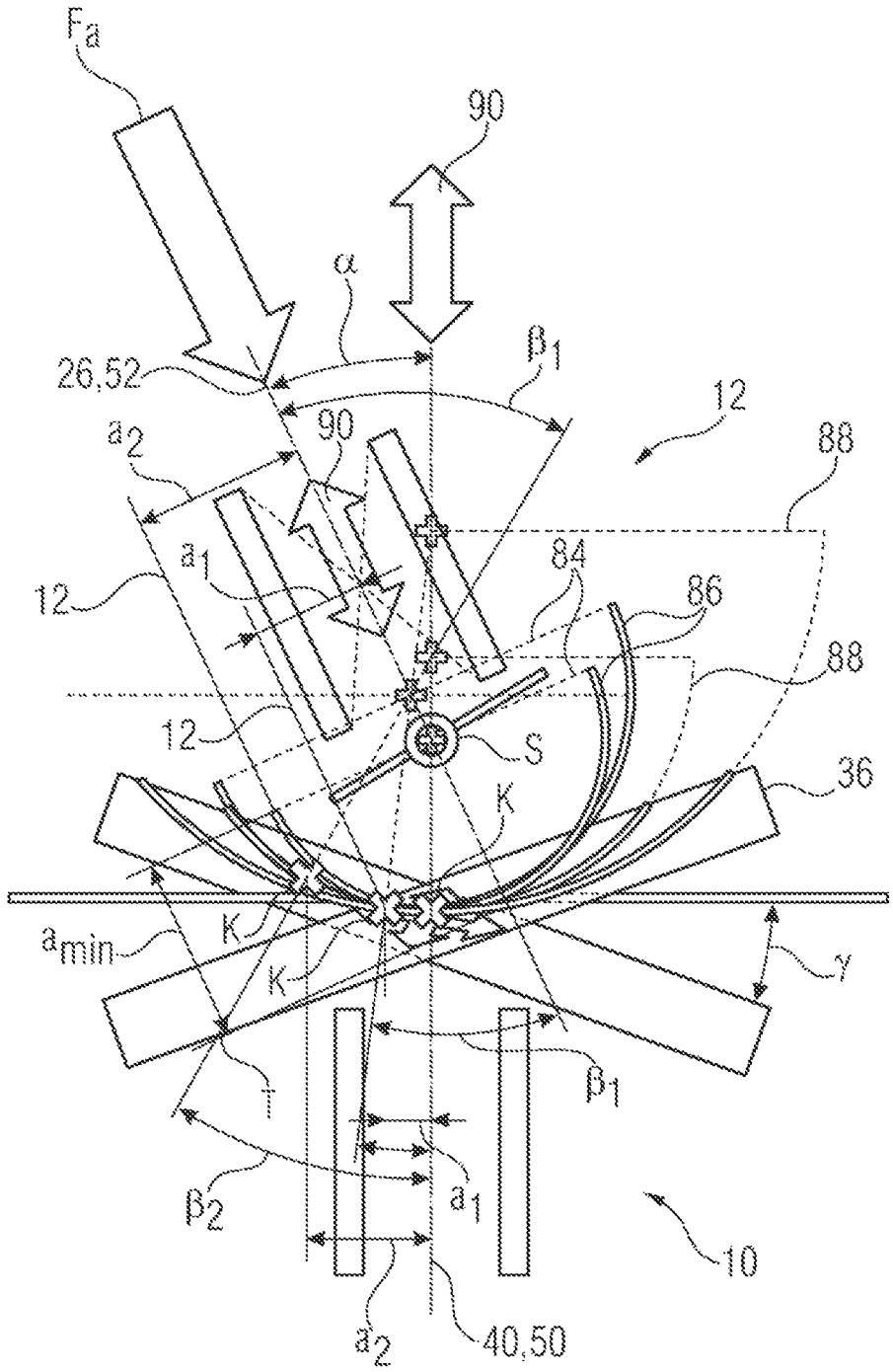
FIG. 10 is a further schematic geometrical illustration of the pressure-influencing device from FIG. 6, for illustrating ideal radius relationships of the calotte-shaped recess and of the calotte-shaped end region.

Owing to Hertzian stresses becoming too large, however, it may also not be expedient to design the rod end radius 84 to be smaller than the spacing $a_{min}$. Said situation—second case—is illustrated in FIG. 10.

In all operating states, however, it is advantageous for a recess radius 88 of the calotte-shaped recess 72 of the traverse 36 to be greater than the rod end radius 84.

In some embodiments, the dimensions ensure adequate stiffness of the traverse 36. In this way, the contact point K is always situated between the axes 50, 52 and a very small variance between "worst case" and "best case" tolerances can be realized.

FIG. 9 illustrates various situations of the rod end radius 84 for the first case. The illustration shows rod ends 48 with three different rod end radii 84. Furthermore, a stroke 90 of the rods 12 is indicated. As can be seen, the contact point 82 of the rod 12 with the largest rod end radius 84 is spaced apart from the rod axis 26 to a considerable extent. The smaller the rod end radius becomes, the smaller said spacing $a_2$ also becomes. With a reduction of said spacing $a_2$, the contact angle $\beta$ and thus the transverse forces acting on the pressure-influencing devices 28 are simultaneously also reduced. As can be seen, in FIG. 9, the situation is at its best if the rod end radius 84 is smaller than $a_{min}$.

Owing to the Hertzian stresses, it may however also be expedient for the rod end radius 84 to be selected to be greater than $a_{min}$. This configuration also constitutes a significant improvement in relation to the situation in FIG. 5, as long as the recess radius 88 has a minimum radius which is considerably greater than the rod end radius 84.

The situation—second case—is illustrated in FIG. 10 for two different recess radii 88. The illustration likewise shows two rods 12 with different end radii 84 in a range greater than $a_{min}$. It can be seen that, in the case of the relatively small recess radius 88 for the relatively large rod end radius 84, a contact point K is realized which is spaced apart from the rod axis 26 to a considerable extent. In the case of the relatively large recess radius 88, however, the contact points K both for the relatively small rod end radius 84 and for the relatively large rod end radius 84 are situated relatively close to the rod axis 26.

Figure 11:
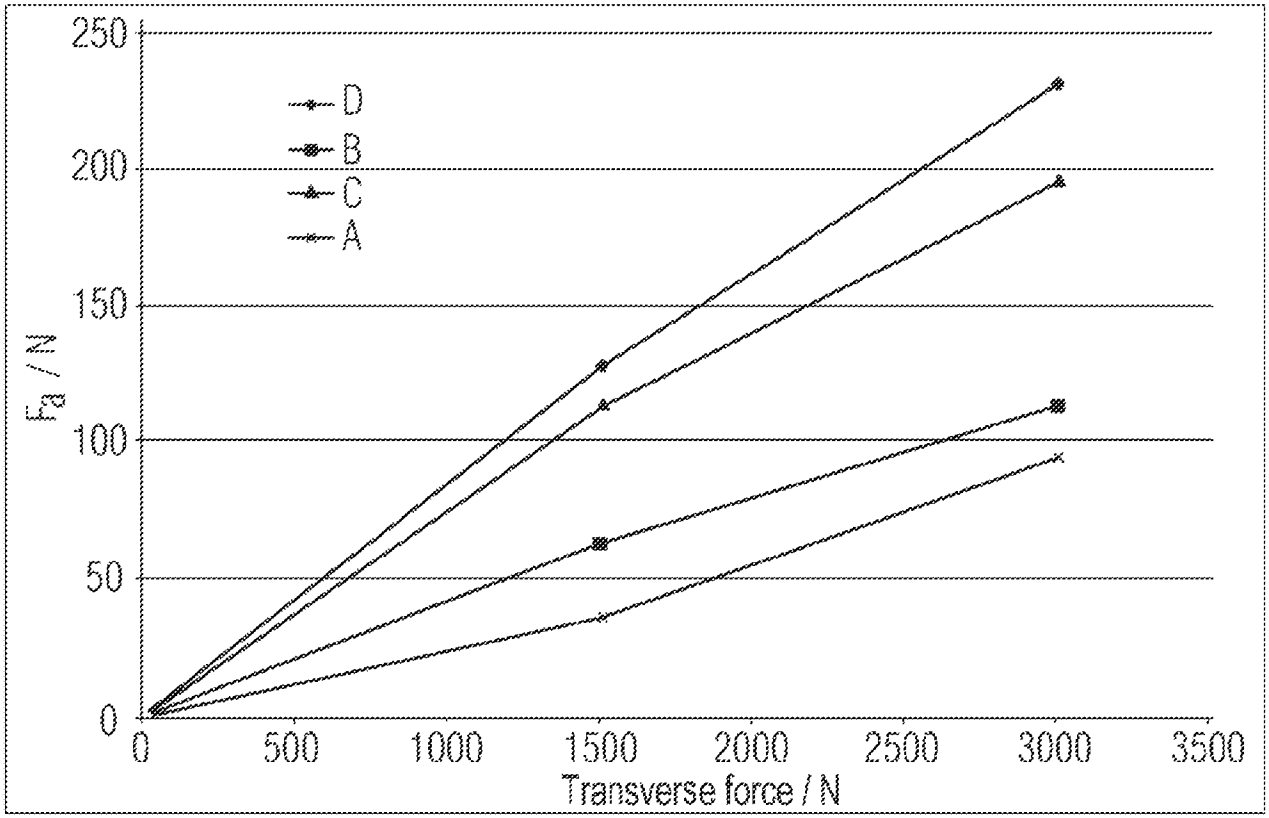
FIG. 11 shows a diagram which illustrates the radial forces, which prevail in different geometrical arrangements of the pressure-influencing device, in a manner dependent on the force acting on a rod axis according to teachings of the present disclosure.
Figure 12:
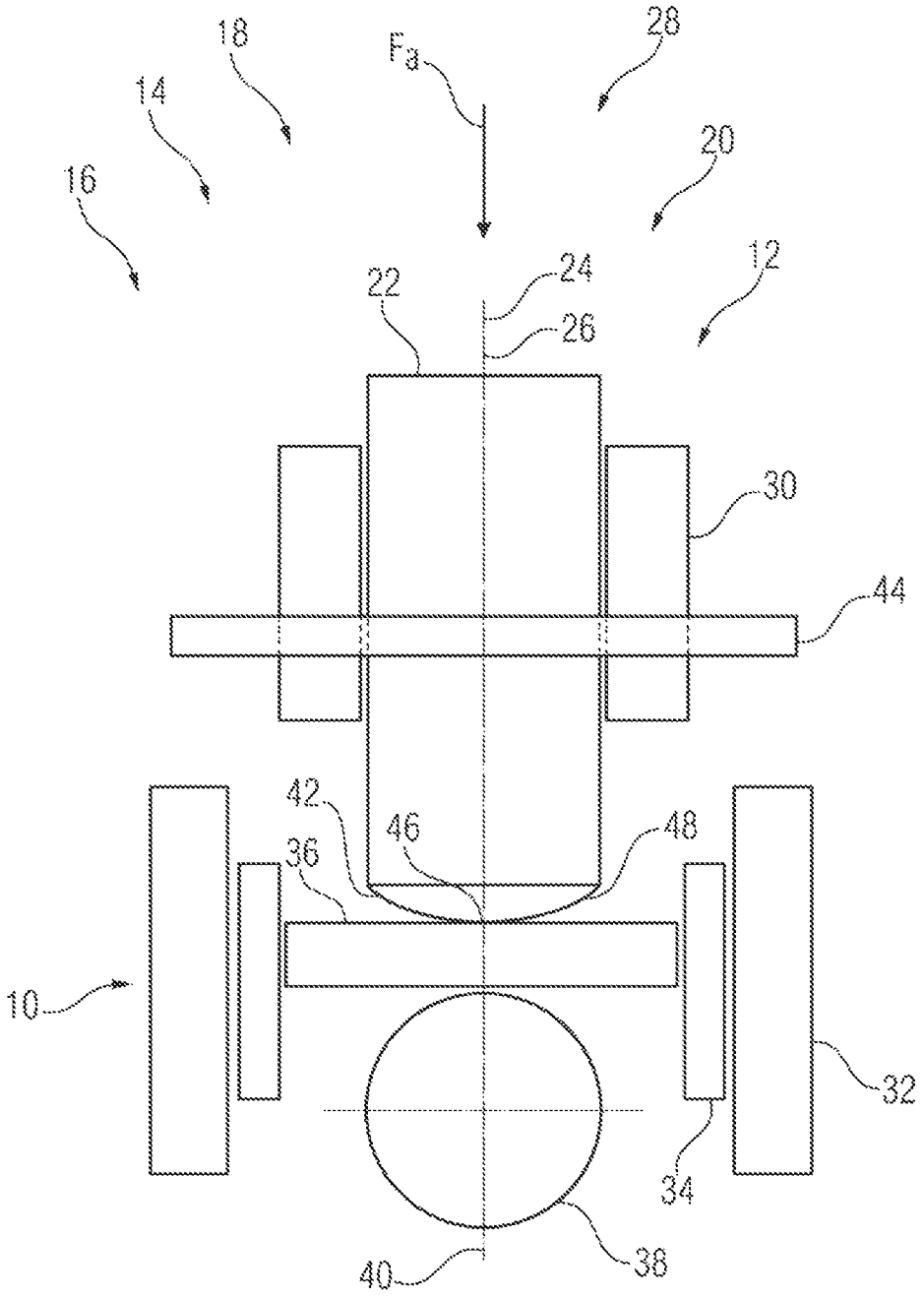
FIG 12 Prior art
FIG. 12 shows a pressure-influencing device according to the prior art, without geometrical errors.
Figure 13:
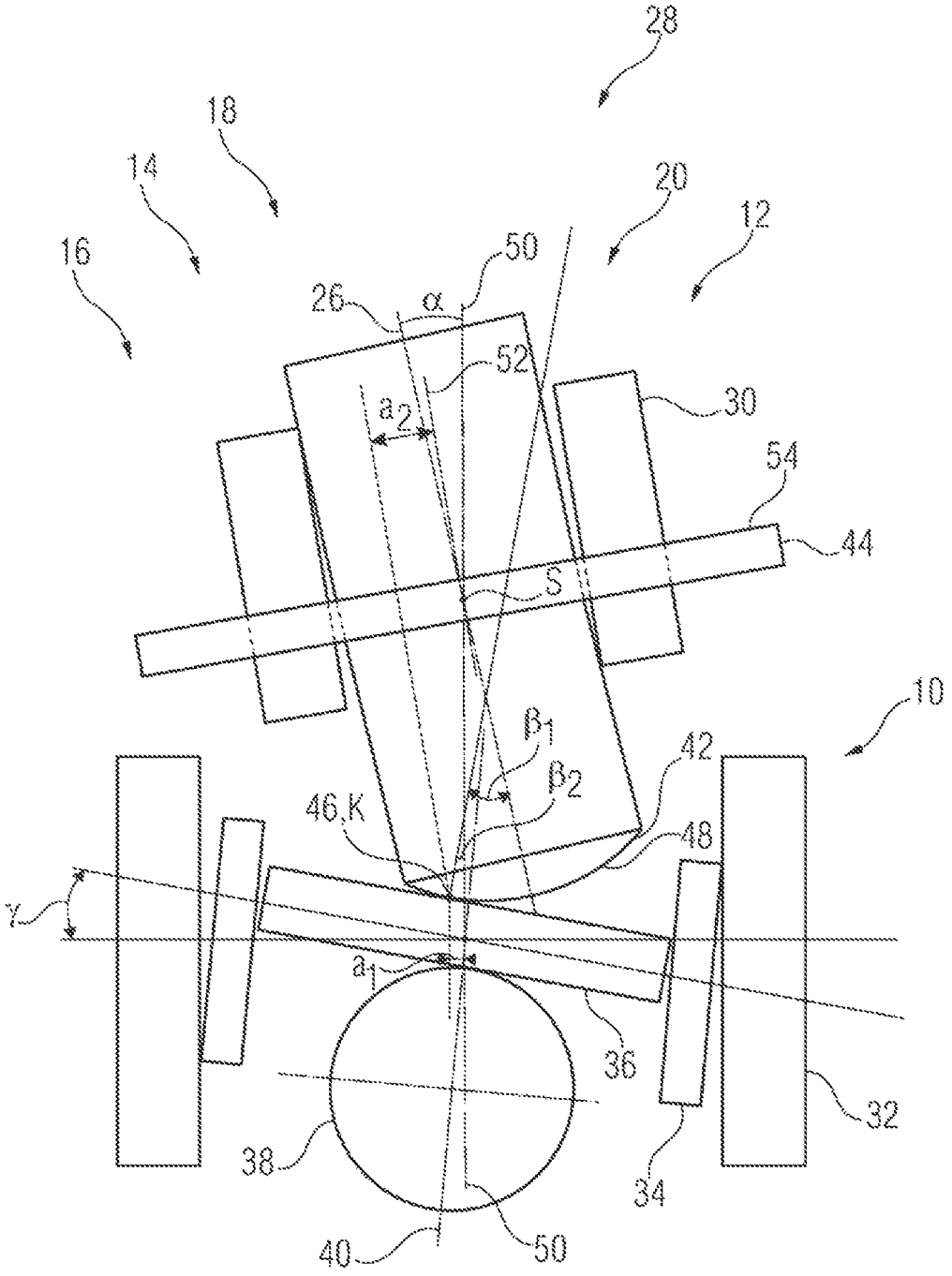
FIG 13 Prior art
FIG. 13 shows a pressure-influencing device according to the prior art, with geometrical errors.

FIG. 11 shows a diagram illustrating the transverse force, which acts on the pressure-influencing device 28, as a function of the axial load $F_a$. The forces for four different arrangements of the pressure-influencing device 28 are plotted. Diagram A illustrates the force conditions for a pressure-influencing device 28 without calotte-shaped recess 72 in the traverse 36 for the "best case" situation, which is shown in FIG. 7 with the contact point 82.

By contrast, the Diagram C illustrates the situation for a pressure-influencing device 28 without calotte-shaped recess 72 for the "worst case" scenario—contact point 78 in FIG. 7.

Diagram B shows the force conditions for a pressure-influencing device 28 which has a calotte-shaped recess 72 in the traverse 36. In the diagram B, the traverse 36 exhibits radial mobility relative to the plunger axis 40.

Diagram D shows the situation of a pressure-influencing device 28 with the calotte-shaped recess 72, but in the case of the traverse 36 being fixed and not being radially movable relative to the plunger axis 40.

It can be clearly seen that the arrangement with calotte-shaped recess 72 and movable traverse 36 provides considerably better force conditions than the "worst case" scenario of the pressure-influencing device 28 without calotte-shaped recess 72. Since the achievement of "worst case" and "best case" cannot be controlled, and the force profile in Diagram B closely resembles the "best case" situation, more effectively controllable force conditions are obtained in a pressure-influencing device 28 with calotte-shaped recess 72. At the same time, the differences between Diagrams B and D show that a radially movable 36 may be very much favored.

Altogether, the calotte-shaped recess 72 generates direction-independent transverse forces which lie at a low level between "best case" and "worst case" of the pressure-influencing device 28 according to the prior art. This corresponds to a general reduction of the acting transverse forces.

Altogether, the transverse forces arising from the axial forces $F_a$ owing to geometrical discontinuities of the components can be reduced by up to 40% in relation to the "worst case" configuration from the prior art. The detrimental influences of the transverse forces owing to the contact angles $\beta_1$, $\beta_2$ can be largely eliminated, leading to a reduction of the transverse forces. At the same time, the perpendicularity of the traverse 36 with respect to the plunger axis 40 is virtually irrelevant, which leads to a reduction in production costs. The calotte-shaped recess 72 of the traverse 36 can be generated by way of simple stamping, which is particularly inexpensive. Altogether, the angle error $\gamma$ is eliminated entirely, and the variance and magnitude of the overall angle error $\beta_1$ and $\beta_2$ is considerably reduced, such that, for the design process, virtually constant loads can be expected, and the "best case" and "worst case" advantageously lie close together. Additionally, with skilled pairing of the rod radius 84 and of the recess radius 88, it is even possible for $\beta_1$ and $\beta_2$ to be kept smaller than the inevitable angle error $\alpha$ between the axes 50, 52 of the guides.

These advantages can be utilized in order to increase the axial load $F_a$ overall, to improve the service life of the guides 30, 32, that is to say increase robustness, to reduce the required guide lengths, which is associated with a reduction in costs and reduction in size of structural space, and, altogether, to increase the tolerances of the components, which likewise contributes to a reduction in costs in the production process.

In some embodiments, the calotte-shaped recess 72 may be provided in a separate slide shoe which is arranged in the plunger 10.

REFERENCE DESIGNATIONS

10 Plunger
12 Rod
14 Piston pump
16 High-pressure fuel pump
18 Engine valve
20 Piston
22 First end region
24 Piston axis
26 Rod axis
28 Pressure-influencing device
30 Rod guide
32 Plunger guide
34 Plunger skirt
36 Traverse
38 Roller
40 Plunger axis
42 Second end region
44 Flange
46 Contact point
48 Rod end
50 Plunger guide axis
52 Rod guide axis
54 Flange surface
56 Internal combustion engine
58 Flange plane

60 First, top dead center
62 Second, bottom dead center
65 Camshaft
66 Plunger drive
68 Contact region
70 Traverse surface
72 Calotte-shaped recess
74 Calotte-shaped end region
76 Longitudinal axis of traverse
78 Contact point "worst case"
80 Contact point "neutral case"82 Contact point "best case"
84 Rod end radius
86 Rod calotte surface
88 Recess radius
90 Stroke
$\alpha$ Angle error (plunger guide axis—rod axis)
$\beta_1$ Contact angle (rod axis—normal to traverse at contact point)
$\beta_2$ Contact angle (plunger guide axis/plunger—normal to traverse at contact point)
$\gamma$ Angle error of traverse (angle of traverse relative to plunger guide)
A "Best case" without calotte-shaped recess
B Movable traverse with calotte-shaped recess
C "Worst case" without calotte-shaped recess
D Fixed traverse with calotte-shaped recess
K Contact point between rod and traverse
P Arrow
S Intersection point of plunger axis/rod axis
T Tangent
$F_a$ Axial load/Hertzian stress/axial force
$a_1$ Spacing of contact point to plunger guide axis/plunger axis
$a_2$ Spacing of contact point to rod guide axis/rod axis
$a_{min}$ Spacing of tangent to rod calotte surface to intersection point of plunger axis/rod axis

What is claimed is:

1. A high-pressure pump for pressurizing a fuel, the high pressure pump comprising:

a piston movable along a piston axis between a top dead center and a bottom dead center, a plunger with a traverse arranged substantially perpendicular to a plunger axis and transmitting kinetic energy from a plunger drive to the piston in a contact region between a traverse surface and an end region of the piston, wherein the piston includes a calotte-shaped end region in the contact region of the piston, and the traverse includes a calotte-shaped recess in the contact region of the traverse;

wherein a recess radius of the calotte-shaped recess of the traverse is at least twice a piston end radius of the calotte-shaped end region of the piston.

2. A device for influencing a pressure in a medium, the device comprising:

a rod with a first end region delimiting a space filled with the medium, the rod movable along a rod axis between a top dead center and a bottom dead center;

a plunger having a traverse arranged substantially perpendicular to a plunger axis for transmitting kinetic energy from a plunger drive to the rod in a contact region between a traverse surface and a second end region of the rod arranged opposite the first end region;

wherein the rod includes a calotte-shaped end region in the contact region of the rod and the traverse includes a calotte-shaped recess in the contact region of the traverse; and wherein a recess radius of the calotte-shaped recess of the traverse is at least twice a rod end radius of the calotte-shaped end region of the rod.

3. The device as claimed in claim 2, wherein the traverse includes a traverse surface in regions adjoining the calotte-shaped recess, the traverse surface having planar form substantially perpendicular to the plunger axis.

4. The device as claimed in claim 2, wherein the calotte-shaped recess is formed into the traverse surface by stamping.

5. The device as claimed in claim 2, wherein the calotte-shaped recess is arranged symmetrically about an axis which bisects the traverse perpendicularly to the longitudinal axis thereof.

6. The device as claimed in claim 2, wherein the traverse is movable radially with respect to the plunger axis, wherein the traverse is inserted into the plunger without radial fastenings.

7. The device as claimed claim 2, further comprising a rod guide having a rod guide axis, wherein a rod end radius of the calotte-shaped end region of the rod is smaller than or equal to a spacing at the top dead center of the rod, between a tangent to a rod calotte surface at the rod axis and an intersection point of the plunger axis and the rod guide axis.

8. The device as claimed claim 2, further comprising a rod guide having a rod guide axis, wherein a rod end radius of the calotte-shaped end region of the rod is greater than a spacing, which exists at the top dead center of the rod, between a tangent to a rod calotte surface at the rod axis to an intersection point of the plunger axis and the rod guide axis, wherein a recess radius of the calotte-shaped recess of the traverse is greater than a rod end radius of the calotte-shaped end region of the rod, to such an extent, in the case of identical materials being used, that the Hertzian stress is situated in the region of contact between a planar traverse surface and a calotte-shaped end region of the rod.

9. A valve for an internal combustion engine, the valve comprising:

a rod with a first end region delimiting a space filled with a fuel, the rod movable along a rod axis between a top dead center and a bottom dead center to open an engine valve;

a plunger having a traverse arranged substantially perpendicular to a plunger axis for transmitting kinetic energy from a plunger drive to the rod in a contact region between a traverse surface and a second end region of the rod arranged opposite the first end region;

wherein the rod includes a calotte-shaped end region in the contact region of the rod and the traverse includes a calotte-shaped recess in the contact region of the traverse; and wherein a recess radius of the calotte-shaped recess of the traverse is at least twice a rod end radius of the calotte-shaped end region of the rod.

* * * * *